US005556202A

United States Patent [19]

Dorn

[11] Patent Number: 5,556,202

[45] Date of Patent: Sep. 17, 1996

[54] PIVOTTY MOUNTED DRUM TYPE MIXER

[76] Inventor: Gordon J. Dorn, RR 1, Box 302, Denver, Iowa 50622

[21] Appl. No.: 509,446

[22] Filed: Jul. 31, 1995

[51] Int. Cl.[6] ..... B01F 9/02

[52] U.S. Cl. ..... 366/213; 366/220

[58] Field of Search ..... 366/53–55, 62, 366/63, 208, 209, 213, 217, 219–220, 232

[56] References Cited

U.S. PATENT DOCUMENTS

| | | | |
|---|---|---|---|
| 42,129 | 3/1864 | True . | |
| 209,023 | 10/1878 | Coman | 366/220 X |
| 366,591 | 7/1887 | Lundie | 366/54 |
| 581,687 | 5/1897 | Blundell | 366/220 |
| 849,540 | 4/1907 | Garred | 366/213 |
| 1,424,154 | 8/1922 | Clark . | |
| 1,755,763 | 4/1930 | Barber | 366/213 X |
| 1,935,212 | 11/1933 | Levy et al. . | |
| 2,543,279 | 2/1951 | Erwin . | |
| 2,868,519 | 1/1959 | Tocci | 366/209 |
| 3,086,332 | 4/1963 | Wentz | 366/232 X |
| 3,090,604 | 5/1963 | Wheeler | 366/213 |
| 3,371,913 | 3/1968 | Muench, Sr. . | |
| 3,374,584 | 3/1968 | Haught | 366/208 X |
| 3,533,603 | 10/1970 | Kovacs | 366/220 |
| 4,235,553 | 11/1980 | Gall | 366/208 |

FOREIGN PATENT DOCUMENTS

| | | | |
|---|---|---|---|
| 397733 | 6/1909 | France | 366/220 |
| 660377 | 7/1929 | France | 366/220 |
| 672020 | 12/1929 | France | 366/220 |
| 846387 | 9/1939 | France | 366/220 |
| 1033171 | 8/1983 | U.S.S.R. | 366/219 |
| 1098558 | 6/1984 | U.S.S.R. | 366/220 |
| 1475702 | 4/1989 | U.S.S.R. | 366/220 |
| 122749 | 10/1918 | United Kingdom | 366/220 |

*Primary Examiner*—Charles E. Cooley
*Attorney, Agent, or Firm*—James C. Nemmers

[57] ABSTRACT

A drum-type mixer that has a cylindrical-shaped drum mounted eccentrically on a shaft that is affixed to the exterior of the drum at diametrically opposed corners of the ends of the drum. The shaft does not extend into the interior of the drum, and thus a removable drum containing the materials to be mixed can be secured inside the exterior drum during mixing operation and removed with the now-mixed contents. Other versions of the invention mount the drum and drive shaft on a pivotly mounted subframe that permits the drum to be tilted to either an upright or horizontal position for ease of loading and unloading.

4 Claims, 3 Drawing Sheets

FIG. 1
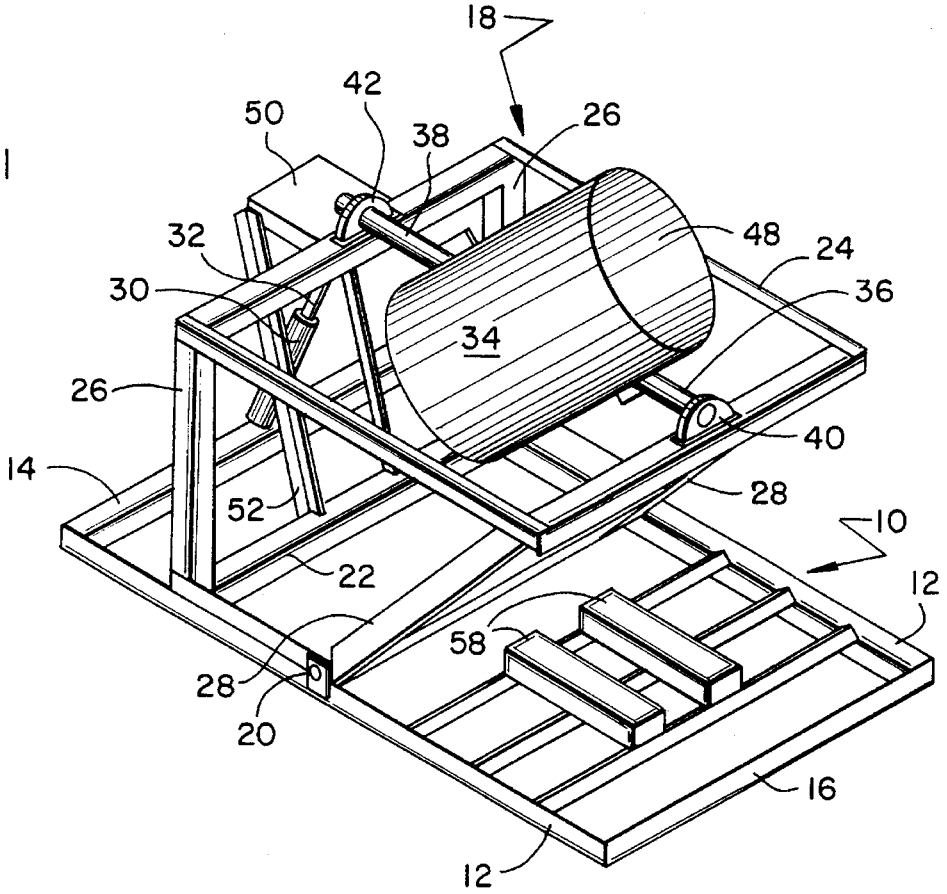
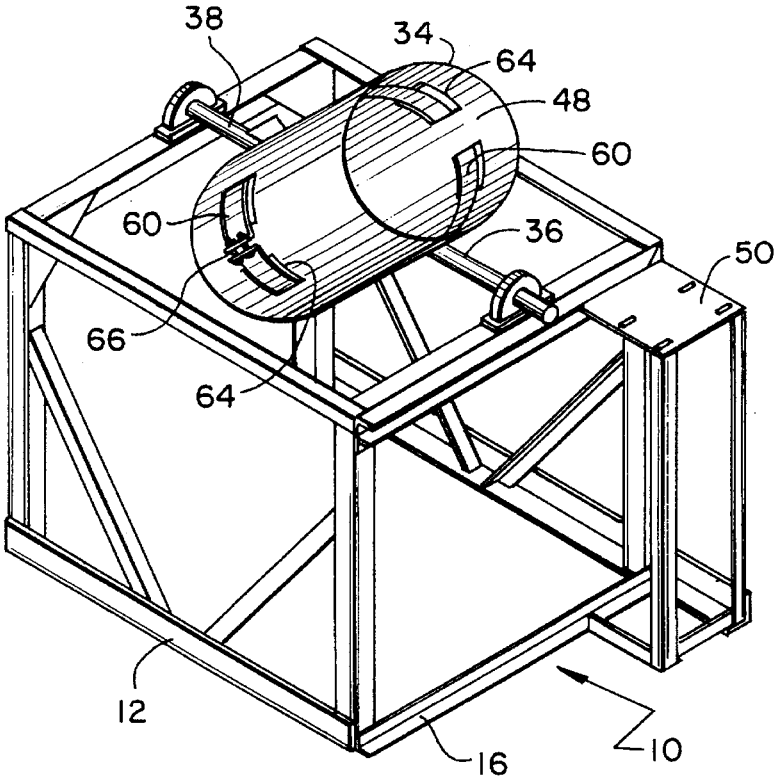
FIG. 8

FIG. 5
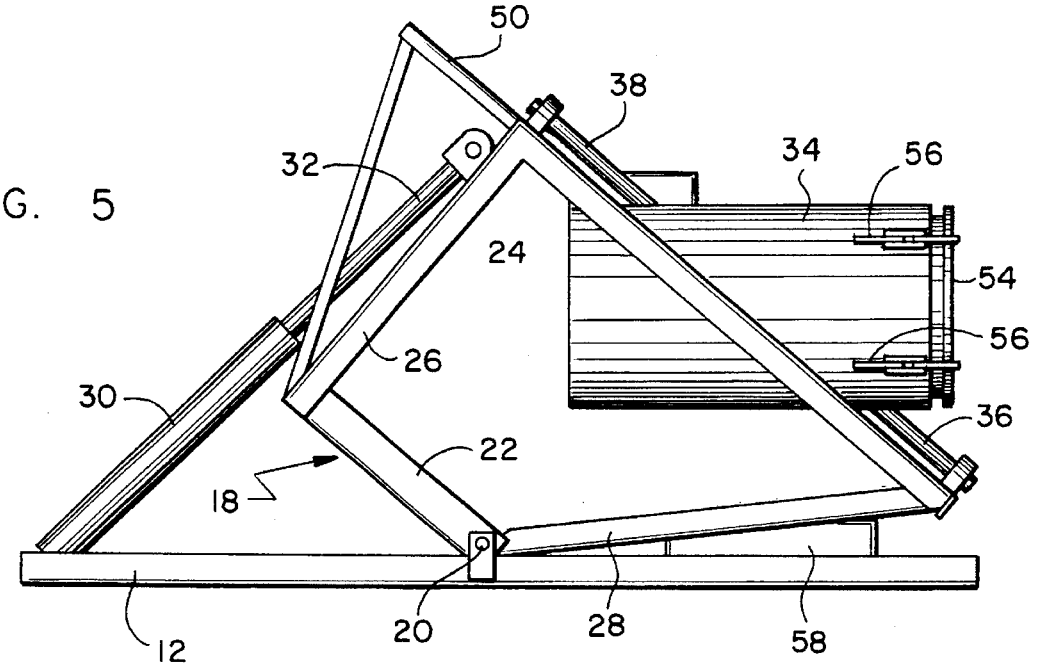
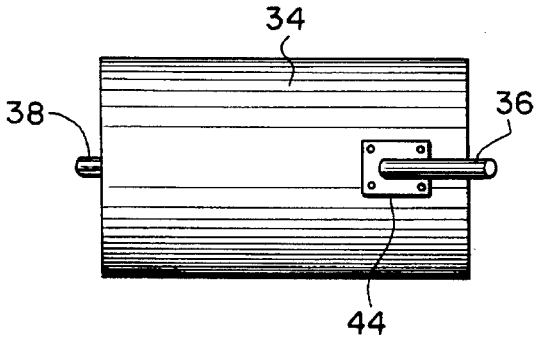
FIG. 2
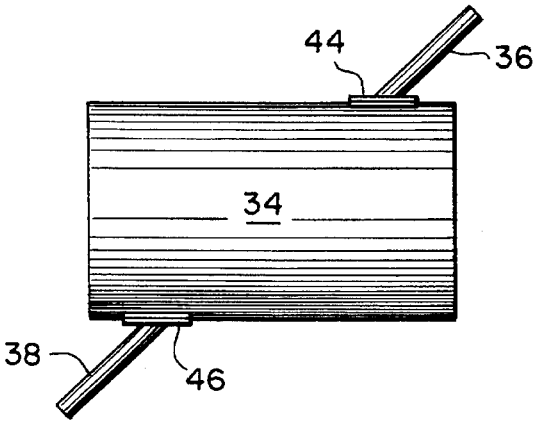
FIG. 3
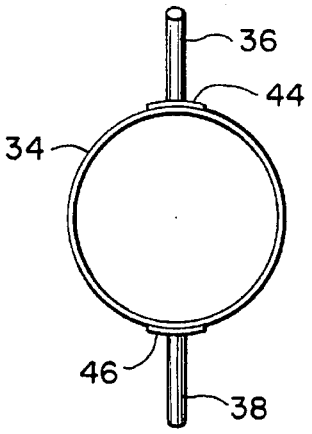
FIG 4

PIVOTTY MOUNTED DRUM TYPE MIXER

BACKGROUND OF THE INVENTION

There are many different designs for devices that can be used to mix a variety of wet and dry products. Some of these are used in continuous mixing systems, while most of them are batch-type mixers in which the products to be mixed are placed in an enclosure and then agitated. There are many known types of agitators in batch-type mixers, and many of them are limited for mixing a specific type of product. Also, there are known designs in which the enclosure itself is rotated or revolved or otherwise moved while stationary baffles inside of the enclosure provide the necessary agitation to mix the products. Depending upon the type of products to be mixed, many of these mixers are ineffective to thoroughly mix the materials. There is known a relatively simple mixer consisting of a cylindrical-shaped drum mounted eccentrically on an axis so that when the drum is rotated, the material will be moved from one end of the drum to the other and from top to bottom in a somewhat figure 8 type pattern. This type of design is very effective for thoroughly mixing dry materials, especially when one of the materials is a fine powder and the other is a heavy granular material. However, extending the shaft upon which the drum is mounted through the inside of the drum limits the usefulness of the drum and can make cleaning of the mixer more difficult, especially if the mixer is used to mix different products. For example, in many applications, it is desirable to remove the drum or remove an inner drum in which the material can be otherwise stored and shipped. The removability of the drum greatly increases the use of the drum and types of products that can be mixed and stored.

There is therefore a need for an improved mixer that can be used for a variety of dry products as well as some wet products.

There is a further need for an improved, simple drum-type mixer which eliminates some of the problems of cleaning so that the same mixer can be used for different products without the fear of contamination of one product with the other.

There is an additional need for an improved, simple drum-type mixer that is inexpensive to manufacture.

SUMMARY OF THE INVENTION

The drum-type mixer of the invention utilizes a cylindrical-shaped drum mounted eccentrically on a shaft that is affixed to the exterior of the drum at diametrically opposed corners of the ends of the drum. This shaft does not extend into the interior of the drum. The drum may be manually or power driven. One embodiment of the invention includes a removable drum inside of the exterior drum while another version mounts the drum and drive shaft on a pivotly mounted subframe that permits the drum to be tilted upright for filling and horizontally for ease of unloading.

BRIEF DESCRIPTION OF THE DRAWING

FIG. 1 is a perspective view of a mixer constructed according to the principles of the invention and showing a side-loading drum and showing the drum in a mixing position;

FIG. 2 is a top or plan view of the drum portion and drive shaft separated from the mixer;

FIG. 3 is a side elevational view of the drum of FIG. 2;

FIG. 4 is an end view of the drum of FIGS. 2 and 3;

FIG. 5 is a view of the mixer of FIG. 1 showing the subframe tilted to position the drum in a horizontal position for side loading;

FIG. 8 is a perspective view of another embodiment of the mixer of the invention.

DESCRIPTION OF THE PREFERRED EMBODIMENTS OF THE INVENTION

Figure 6:
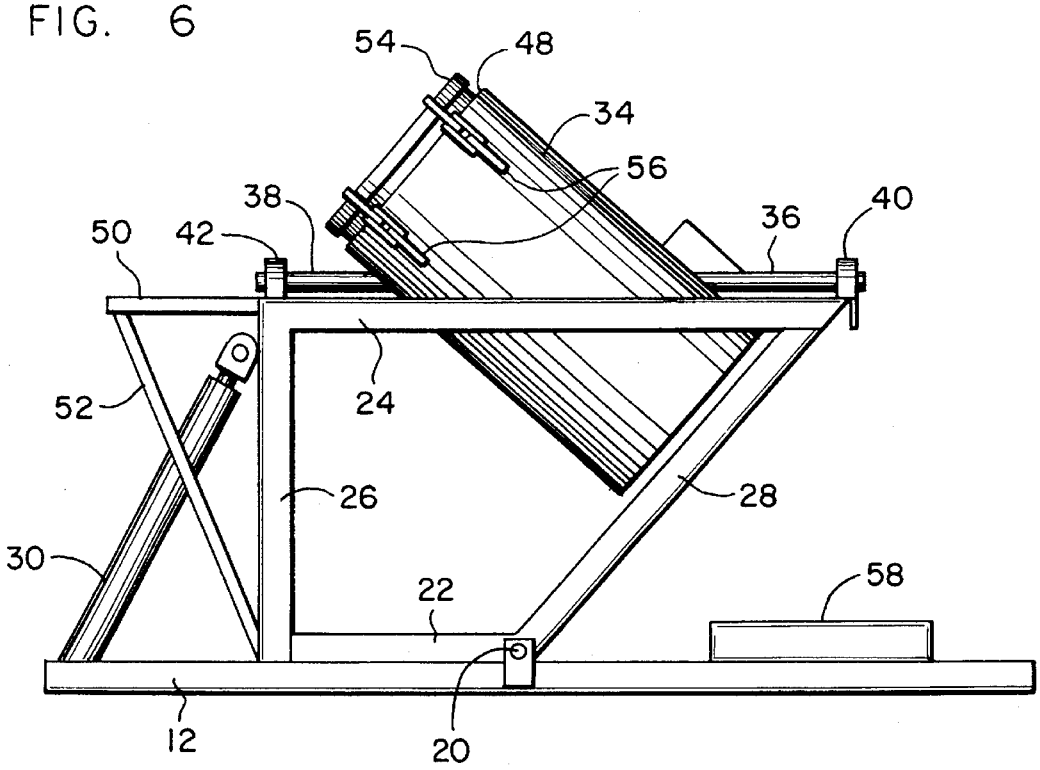
FIG. 6 is a side elevational view of another embodiment of the mixer showing a top-loading drum and showing the drum in a mixing position.

Referring first to FIGS. 1 and 5, there is shown a main base frame 10 that is rectangular in shape with parallel spaced apart side members 12 joined by end members 14 and 16. The side members 12 and end member 14 and 16 are preferably formed of structural steel members such as angle irons. A subframe, indicated generally by the reference numeral 18, is pivotly mounted on pivots 20, one on each of the side members 12. The subframe 18 consists of a lower frame 22 and an upper frame 24 located in a plane parallel to the lower frame 22. Rear vertical uprights 26 and forward angled uprights 28 join the upper frame 24 to the lower frame 22. The pivots 20 pivotly secure the lower frame 22 of subframe 18 to the base frame 10.

A hydraulic cylinder 30 has one end pivotly connected to the end member 14 while the operating rod 32 of the hydraulic cylinder 30 is pivotly connected to the rear of the upper frame 24. Thus, actuation of the hydraulic cylinder 30 will move the subframe 18 into the desired position between that shown in FIG. 1 for mixing and that illustrated in FIG. 5 for side loading, as will be more fully described hereinafter.

A cylindrical-shaped drum 34 has a longitudinal axis that is eccentrically mounted on the upper frame 24 of the subframe 18 by connection to a forward stub shaft 36 and a rear stub shaft 38 connected to the exterior surface of the drum 34 so as to extend at approximately a 45° angle to the longitudinal axis of the drum 34. Shafts 36 and 38 are turnable in suitable bearing blocks 40 and 42 respectively. The ends of the stub shafts 36 and 38 are securely connected to the exterior surface of the drum 34 by suitable attachment members 40 and 42, as best seen in FIGS. 2, 3 and 4. Thus, when the drum 34 is rotated by rotation of the shafts 36 and 38, the drum will not only revolve but it will be continuously moved from a somewhat upright position to a somewhat inverted position. In other words, when the shafts 36 and 38 are rotated 180° from an initial position with the top or open end of the drum 34 facing upwardly, the drum 34 will then be in a position with the top or open end facing downwardly. FIG. 1 shows the drum 34 with an open end 48 extending upwardly at an angle substantially 45° from the horizontal with the subframe 18 in the mixing position.

The shafts 36 and 38, and thus the drum 34, can be manually rotated by a suitable crank (not shown) driving the drum through a gear train (not shown). However, in most applications, the drum is preferably power driven. The support platform 50 is secured to the rear of the subframe 18 and supported by an angled support 52. This platform provides a place to mount a suitable electric motor (not shown) with a gear reducing drive that is operatively connected to the stub shaft 36. The drive for the drum is well within the knowledge of those skilled in the art and thus has not been shown.

The drum shown in FIG. 1 is shown with an open end 48, and a suitable cover or lid (not shown) can be placed over the open end 48 of the drum 34 after the material to be mixed is placed inside of the drum 34 to prevent the contents from spilling during the mixing operation. FIG. 5, which is the same construction as FIG. 1, also illustrates the drum 34 as being an outer drum with a removable drum 54 carried inside of drum 34 and secured by suitable fasteners such as clamps 56. In this arrangement, the pivoting subframe 18 provides for ease of loading and unloading of the removable drum 54. FIG. 5 illustrates the subframe pivoted to a position with the forward angled uprights 28 horizontal and resting on suitable stop supports 58 (see FIG. 1). In this position, the removable drum 54 can be placed inside the drum 34, and the material to be mixed placed inside of the removable drum 54, if that drum 54 does not already contain the contents to be mixed. Using the hydraulic cylinder 30, the subframe 18 is now pivoted to the position shown in FIG. 1 in which the upper frame 24 is substantially horizontal and thus the shafts 36 and 38 are horizontal with the longitudinal axis of drum 34 extending at an angle of approximately 45° from horizontal. With the removable drum 54 now secured in place inside of the drum 34, the shafts 36 and 38 are rotated to mix the contents of the removable drum 54. When it is desired to remove the removable drum 54, rotation of the drum 34 is stopped with the open end 48 facing upwardly (the position of FIG. 1) after which the subframe 18 is tipped by hydraulic cylinder 30 so that the drum 34 is in a horizontal position as shown in FIG. 5. This facilitates removal of the removable drum 54.

Figure 7:
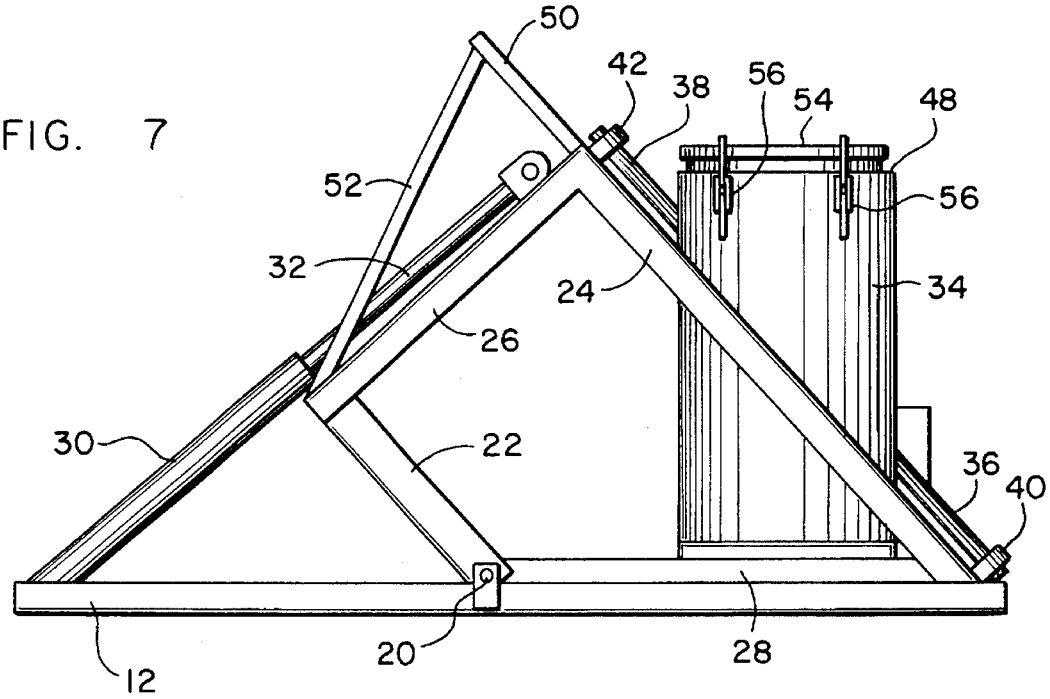
FIG. 7 is a side elevational view showing the subframe tilted to position the drum in a vertical position for top loading.

FIGS. 6 and 7 shown another embodiment of the invention in which the construction of the mixer is the same as that of FIGS. 1 and 5 except the drum 34 has its open end 48 extending toward the rear of the frame 10, i.e., away from the stops 58. With this arrangement, the drum 34 is loaded and unloaded while in a vertical position. The embodiment of FIGS. 6 and 7 also further illustrate the drum-in-a-drum feature, and FIG. 7 shows the subframe 18 tilted downwardly to move the drum 34 into a vertical position for top loading. If this arrangement is used, the material to be mixed is added to the drum 34 with the open end 48 extending vertically upward, and after loading, a cover is placed and secured on the drum 34 or a second drum 54 is placed inside the drum 34 and secured to it. The subframe 18 is then tilted back to the position shown in FIG. 6 and the material mixed by rotating the drum 34. When it is desired to empty the now mixed contents, the drum 34 is stopped with the open end 48 extending upwardly as shown in FIG. 6, after which the subframe 18 is tilted downwardly to the position of FIG. 7. After removal of the cover, if any, the mixed material can be easily unloaded out of the drum 34, or the second drum 54 containing the mixed material is removed.

FIG. 8 shows yet another embodiment of the invention in which there is no pivoting subframe, but rather the drum 34 is mounted at a 45° angle to the axis of rotation of the shafts 36 and 38. In this embodiment of FIG. 8, the removable drum (not shown) is held in place by straps 60 extending through openings 62 and 64, with the free ends of straps 60 being held together by a tightener 66. In this embodiment, the removable drum is inserted into the drum 34, and the tightener 66 is actuated to cause the strap 60 to grip the removable drum and hold it in place during the mixing operation.

Operation of the mixing device of the invention should be evident from the foregoing description. Obviously, with the eccentrically mounted drum, the material placed in the drum for mixing will be moved not only from one end of the drum to the other, but also from top to bottom. The movement of the material during mixing is thus in a generally "figure 8" type pattern which produces a very effective mixing and churning action. This mixing action has been found to be very effective even though the materials to be mixed are different in weight and density. The mixing action is also very gentle and will not break up or damage any of the materials while thoroughly mixing them. The mixing device of the invention has been found effective for mixing and blending a variety of products with no damage to the products. For example, minerals, vitamins, feeds, supplements for feeds, fertilizers, soils, chemicals, and concrete mixtures. The mixing device of the invention has also been found to be effective in mixing liquids as well as dry material. With a very few revolutions of the mixing drum, complete gentle blending and mixing is accomplished. With the use of a removable inner drum, contamination is eliminated if different products are mixed using the same device. Cleaning is also simplified since there is no cleaning required. Moreover, if the outer drum 34 is made of a material that might to damaged by the material being mixed, use of the removable inner drum will protect the drum, and thus the mixer, from deterioration. Thus, there are many advantages of having the capability of placing the materials to be mixed in the removable drum which is then placed inside of the mixing drum attached to the shaft. No contamination or damage from the materials being mixed ever occurs to the mixing device itself. With the added use of the subframe, loading and unloading of the removable drum is simplified.

Having thus described the invention in connection with the preferred embodiments thereof, it will be evident to those skilled in the art that various revisions and modifications can be made to the preferred embodiments described herein without departing from the spirit and scope of the invention. It is my intention however that all such revisions and modifications that are obvious to those skilled in the art will be included within the scope of the following claims.

What is claimed is as follows:

1. A drum-type mixer for mixing two or more materials, said mixer comprising: a base supporting frame for supporting the mixer, a subframe mounted on the base supporting frame and having a lower frame and an upper frame that are spaced from each other and rigidly joined together, the upper frame having a central open area, a cylindrical-shaped main drum having an exterior surface extending between two circular-shaped ends that define an interior of the drum with a longitudinal axis extending through the ends, a rotatable shaft operatively connected to the drum with the axis of rotation of the shaft at an angle to the longitudinal axis of the drum for rotating the drum eccentrically when the shaft rotates, the rotatable shaft being affixed to the exterior surface of the drum and not extending into the interior of the drum, attachment means for supporting the rotatable shaft on the upper frame with the drum positioned in the central open area of the upper frame, pivot means mounting the lower frame of the subframe to the base supporting frame to provide for pivotal movement of the subframe, and power means connected between the base supporting frame and the subframe to pivotally move the subframe and the main drum from a first mixing position to a second loading and unloading position and from the second loading and unloading position to the first mixing position.

2. The drum-type mixer of claim 1 in which the main drum is secured to the rotatable shaft so that the longitudinal axis of the main drum is horizontal when the subframe is pivoted to the loading and unloading position, and one of the circular-shaped ends of the main drum is open and the other circular-shaped end is closed, and a second drum for containing the materials to be mixed is removably positioned inside the main drum through the open end of the main drum and is secured to the main drum during mixing, the second drum being removable when the subframe is pivoted to the loading and unloading position.

3. The drum-type mixer of claim 1 in which the main drum is secured to the rotatable shaft so that the longitudinal axis of the main drum is vertical when the subframe is pivoted to the loading and unloading position, and one end of the main drum is open and the other end is closed, the open end facing upwardly when the subframe is pivoted to the loading and unloading position, and a removable cover is combined with the main drum to close the open end when the main drum is in the first mixing position.

4. The drum-type mixer of claim 1 in which the power means is a hydraulic cylinder having one end connected to the base supporting frame and the other end connected to the upper frame of the subframe, the hydraulic cylinder being operable to move the subframe and main drum to and from the first mixing position and to and from the second loading and unloading position.

* * * * *